US007280783B2

(12) United States Patent
Kusano et al.

(10) Patent No.: US 7,280,783 B2
(45) Date of Patent: Oct. 9, 2007

(54) ELECTROPHOTOGRAPHIC PHOTORECEPTOR AND METHOD OF RECYCLING THE ELECTROPHOTOGRAPHIC PHOTORECEPTOR

(75) Inventors: Tetsuya Kusano, Susono (JP); Makoto Okuzawa, Tagata-gun (JP); Naoyoshi Kusano, Numazu (JP); Junichi Yamazaki, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 110 days.

(21) Appl. No.: 10/981,503

(22) Filed: Nov. 5, 2004

(65) Prior Publication Data

US 2005/0095033 A1 May 5, 2005

(30) Foreign Application Priority Data

Nov. 5, 2003 (JP) ..... 2003-375720

(51) Int. Cl.
*G03G 15/00* (2006.01)

(52) U.S. Cl. ..... 399/109; 399/159; 29/895.1

(58) Field of Classification Search ..... 399/109, 399/159; 29/895.1
See application file for complete search history.

(56) References Cited

U.S. PATENT DOCUMENTS 4,400,077 A * 8/1983 Kozuka et al. ..... 399/117
5,521,678 A * 5/1996 Riehle et al. ..... 399/159
5,576,803 A * 11/1996 Williams et al. ..... 399/116
5,709,765 A 1/1998 Herbert et al.
5,983,055 A 11/1999 Bito et al.

FOREIGN PATENT DOCUMENTS

EP 0 686 888 A2 12/1995
JP 10-115938 5/1998

OTHER PUBLICATIONS

U.S. Appl. No. 11/563,551, filed Nov. 27, 2006, Junichi Yamazaki, et al.
U.S. Appl. No. 11/627,175, filed Jan. 25, 2007, Kusano.

* cited by examiner

*Primary Examiner*—David M. Gray
*Assistant Examiner*—Ruth N. LaBombard
(74) *Attorney, Agent, or Firm*—Oblon, Spivak, McClelland, Maier & Neustadt, P.C.

(57) ABSTRACT

An electrophotographic photoreceptor including a cylindrical substrate including a photosensitive layer on an outer circumferential surface thereof and a flange adhesively fixed to at least one end of the cylindrical substrate. The flange has a joint to which a separation jig is applied to apply a tensility in a direction of separating the flange from the cylindrical substrate. A method of recycling the electrophotographic photoreceptor fills an elastic body with a fluid to inflate and contact the elastic body at the outer circumferential surface of the electrophotographic photoreceptor upon application of pressure to grasp the electrophotographic photoreceptor in the jig, and the jig is applied to the joint to pull the flange in a direction of separating the flange from the cylindrical substrate.

11 Claims, 6 Drawing Sheets

ELECTROPHOTOGRAPHIC PHOTORECEPTOR AND METHOD OF RECYCLING THE ELECTROPHOTOGRAPHIC PHOTORECEPTOR

BACKGROUND OF THE INVENTION

1. Field of the Invention

The present invention relates to an electrophotographic photoreceptor and a method of recycling an electrophotographic photoreceptor.

2. Discussion of the Background

An electrophotographic photoreceptor is formed of an electroconductive cylindrical substrate, an organic or inorganic photosensitive layer formed thereon, and flanges fixed on both ends thereof. The flanges have a shaft, and an electrophotographic photoreceptor in an image forming apparatus is rotated centering around the shaft. The flanges are not only a rotation center of the electrophotographic photoreceptor but also have a function of providing an electrical ground. Since an allowance between the flanges and cylindrical substrate causes abnormal images, the flanges are firmly fixed to the cylindrical substrate with an adhesive or the like.

Recently, to save resources, it has become required or desired that the cylindrical substrate and flanges of an electrophotographic be recycled.

To recycle the cylindrical substrate and flanges, the flanges fixed to the cylindrical substrate have to be removed therefrom.

When the flanges can be removed from the cylindrical substrate without damaging the flanges or cylindrical substrate, they can be used as they are after being removed. The phrase "recyclable as they are" used herein means the cylindrical substrate and flanges separated from each other are reused, i.e. the cylindrical substrate and flanges separated from each other are not melted down to merely recycle their materials.

Japanese Laid-Open Patent Publication No. 10-115938 discloses a method of quenching an adhesive to be peeled with a cooling medium such as liquid nitrogen as a way of recycling a cylindrical substrate and a flange without damaging them. However, the process disclosed therein requires a cooling medium such as liquid nitrogen, and the cooling medium is difficult to store and handle.

SUMMARY OF THE INVENTION

Because of these reasons, the present inventors recognized a need exists for an electrophotographic photoreceptor including a cylindrical substrate and a flange easily separable from each other without damaging them and recyclable as they are.

Accordingly, an object of the present invention is to provide an electrophotographic photoreceptor including a cylindrical substrate and a flange easily separable from each other without damaging them and recyclable as they are.

Another object of the present invention is to provide a method of easily separating a cylindrical substrate and a flange of an electrophotographic photoreceptor from each other without damaging them, and recycling them as they are.

These objects and other objects of the present invention as hereinafter will become more readily apparent can be attained by an electrophotographic photoreceptor including a cylindrical substrate including a photosensitive layer on an outer surface thereof, and a flange adhesively fixed to one end of the cylindrical substrate, wherein the flange has a joint to which a separation jig is applied to apply a tensility in a direction of separating the flange from the cylindrical substrate.

The flange preferably has two or more joints located thereon such that the tensility is uniformly applied to a rim thereof.

Another aspect of the present invention is to provide a method of recycling the electrophotographic photoreceptor, including filling an elastic body with a fluid to inflate and contact the elastic body to an outer circumferential of the electrophotographic photoreceptor upon application of pressure to grasp the electrophotographic photoreceptor in a jig, and applying the separation jig to the joint to pull a flange in a direction of separating the flange from the cylindrical substrate.

Still another aspect of the present invention is to provide a method of recycling the electrophotographic photoreceptor, including moving a movable elastic body to contact the elastic body at an outer circumferential of the electrophotographic photoreceptor upon application of pressure to grasp the electrophotographic photoreceptor in a jig, and applying the separation jig to the joint to pull a flange in a direction of separating the flange from the cylindrical substrate.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like or corresponding parts throughout the several views, and wherein.

DETAILED DESCRIPTION OF THE INVENTION

Figure 1:
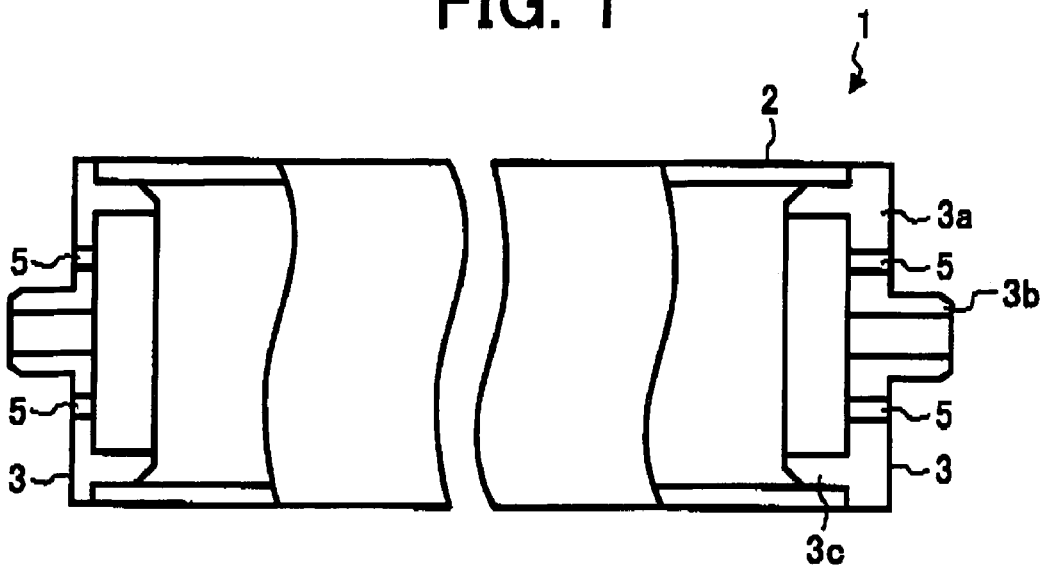
FIG. 1 is a schematic longitudinal sectional view illustrating a first embodiment of an electrophotographic photoreceptor of the present invention.

Generally, the present invention provides an electrophotographic photoreceptor including a cylindrical substrate and a flange easily separable from each other without damaging them and recyclable as they are, and a method of easily separating a cylindrical substrate and a flange of an electrophotographic photoreceptor from each other without damaging them, and recycling them as they are.

The electrophotographic photoreceptor of the present invention includes a cylindrical substrate including a photosensitive layer on an outer circumferential surface thereof, and a flange adhesively fixed to at least one end, and typically to each of both ends, of the cylindrical substrate, wherein each flange has a joint to which a separation jig is applied to apply a tensility in a direction of separating the flanges from the cylindrical substrate.

Therefore, the separation jig grasps the electrophotographic photoreceptor so as not to be deformed, being applied to the joint formed on a flange to pull the flange in the direction of separating the flange from the cylindrical substrate. The flange and cylindrical substrate are easily separated from each other without being damaged, and they are recyclable as they are. In addition, the flange can simply be prepared at low cost because of having a joint.

The flange may have two or more joints located thereon such that the tensility is uniformly applied to a rim thereof. Therefore, when the flange is pulled to be separated from the cylindrical substrate, the rim of the flange can be prevented from pressing against an inner circumferential surface of the cylindrical surface with an uneven pressure, and damage to the flange and cylindrical substrate can be more surely prevented.

A method of recycling the electrophotographic photoreceptor of the present invention includes filling an elastic body with a fluid to inflate and contact the elastic body at an outer circumferential of the electrophotographic photoreceptor upon application of pressure to grasp the electrophotographic photoreceptor in a jig, and applying the separation jig to the joint to pull a flange in a direction of separating the flange from the cylindrical substrate.

Therefore, the electrophotographic photoreceptor is grasped in a jig, and the separation jig is applied to the joint formed on a flange and pulls the flange in a direction of separating the flange from the cylindrical substrate. When the electrophotographic photoreceptor is grasped in a jig, since an inflated elastic body in which a fluid is filled is pressed against an outer circumferential surface of the electrophotographic photoreceptor, a pressure to grasp the electrophotographic photoreceptor is almost uniformly applied thereto and the electrophotographic photoreceptor is grasped without deformation of the cylindrical substrate. When the flange is pulled in the direction of separating the flange from the cylindrical substrate after the elastic body is pressed against the outer circumferential surface of the electrophotographic photoreceptor to grasp the electrophotographic photoreceptor, the electrophotographic photoreceptor grasped with the elastic body pressed against the outer circumferential surface thereof can be displaceable according to the pulling direction. Therefore, the flange can be pulled without pressing the rim thereof against the inner circumferential surface of the cylindrical substrate with an uneven pressure, and the cylindrical substrate and flange can be separated from each other without being damaged and can be recyclable as they are. The operation of separating the flange from the cylindrical substrate with the jig for grasping and the separation jig can easily be performed.

Another method of recycling the electrophotographic photoreceptor according of the present invention includes moving a movable elastic body to contact the elastic body at an outer circumferential surface of the electrophotographic photoreceptor upon application of pressure to grasp the electrophotographic photoreceptor in a jig, and applying the separation jig to the joint to pull a flange in a direction of separating the flange from the cylindrical substrate.

Therefore, the electrophotographic photoreceptor is grasped in a jig, and the separation jig is applied to the joint formed on a flange and pulls the flange in a direction of separating the flange from the cylindrical substrate. When the electrophotographic photoreceptor is grasped in a jig, since a movable elastic body is moved to be pressed against an outer circumferential surface of the electrophotographic photoreceptor, a pressure to grasp the electrophotographic photoreceptor is almost uniformly applied thereto and the electrophotographic photoreceptor is grasped without deformation of the cylindrical substrate. When the flange is pulled in the direction of separating the flange from the cylindrical substrate after the elastic body is pressed against the outer circumferential surface of the electrophotographic photoreceptor to grasp the electrophotographic photoreceptor, the electrophotographic photoreceptor grasped with the elastic body pressed against the outer circumferential surface thereof can be displaceable according to the pulling direction. Therefore, the flange can be pulled without pressing the rim thereof against the inner circumferential surface with an uneven pressure, and the cylindrical substrate and flange can be separated from each other without being damaged and can be recyclable as they are. The operation of separating the flange from the cylindrical substrate with the jig for grasping and the separation jig can easily be performed.

The elastic body may have a hardness of from 10 to 90 when measured by a method specified in JIS K6253 using a durometer. Therefore, when the electrophotographic photoreceptor is grasped with the elastic body pressed against the outer circumferential surface thereof, deformation of the cylindrical substrate due to too high a hardness of the elastic body can be prevented.

In addition, the elastic body may have a contact area with the electrophotographic photoreceptor upon application of pressure not less than 12 $cm^2$. Therefore, when the electrophotographic photoreceptor is grasped with the elastic body pressed against the outer circumferential surface thereof, an increase of the pressure against the electrophotographic photoreceptor is prevented and deformation of the cylindrical substrate due to the pressure can be prevented.

Figure 2:
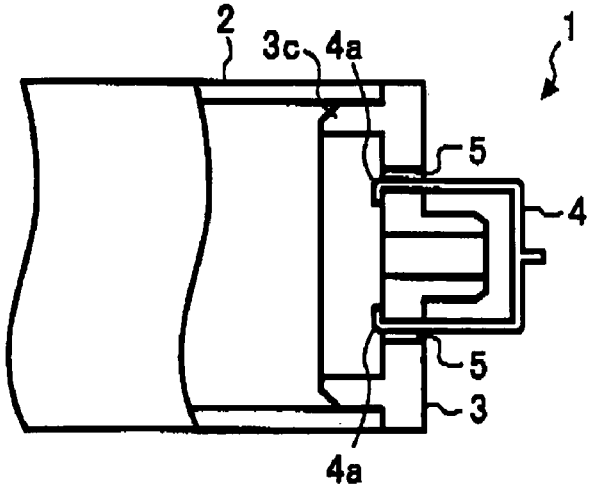
FIG. 2 is a schematic longitudinal sectional view illustrating a separation jig applied to a flange of the first embodiment of the electrophotographic photoreceptor in FIG. 1.

FIG. 1 is a schematic longitudinal sectional view illustrating a first embodiment of the electrophotographic photoreceptor of the present invention, FIG. 2 is a schematic longitudinal sectional view illustrating that a separation jig is applied to a flange of the first embodiment of the electrophotographic photoreceptor in FIG. 1, and FIGS. 3A to 3F are drawings illustrating a first embodiment of procedures of separating the flange from the cylindrical substrate in the present invention.

As shown in FIGS. 1-3F, an electrophotographic photoreceptor 1 has a cylindrical substrate 2 including a photosensitive layer on an outer circumferential surface thereof, and a pair of flanges 3 adhesively fixed to both ends of the cylindrical substrate.

The cylindrical substrate 2 can be formed as follows, as a non-limiting example.

A cylinder from an aluminum base alloy based on JIS A3100, having a length of 340 mm, an outer diameter of 60.2 mm and an inner diameter of 57.5 mm is formed, and the cylinder is turned on a lathe to have an outer diameter of 60.0 mm to form the cylindrical substrate 2 formed of the aluminum base alloy.

Then, the cylindrical substrate 2 formed of the aluminum base alloy is washed by a jet water washer to remove oil adhered on the surface thereof. When washed, a surfactant and an ultrasonic oscillator can be used together. After washing with jet water, a further washing is executed with pure water for three times to completely remove the surfactant, and the cylindrical substrate 2 is then dried.

Next, the following materials are mixed to prepare a coating liquid:

| | |
|---|---|
| Titanium oxide | 20 parts by weight |
| Alkyd resin | 10 parts by weight |
| Melamine resin | 10 parts by weight |
| Methyl ethyl ketone | 60 parts by weight |

A coating liquid is then coated on the surface of the cylindrical substrate 2 by a dip coating method, and heated at 150° C. for 15 minutes to harden the resin and form an undercoat layer having a thickness of 5 μm thereon.

Then, the following materials are mixed to prepare a coating liquid for forming a charge generation layer:

| | |
|---|---|
| Butyral resin XYHL from Union Carbide Corp. | 1 parts by weight |
| Disazo pigment having the following formula: | 9 parts by weight |

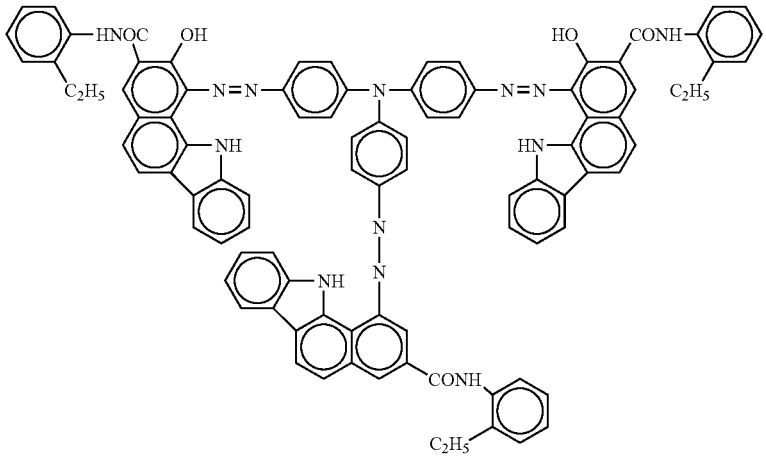

| | |
|---|---|
| Cyclohexanone | 30 parts by weight |
| Tetrahydrofuran | 30 parts by weight |

The coating liquid is coated on the undercoat layer by a dip coating method, and dried at 100° C. for 10 minutes to form a charge generation layer thereon.

Further, the following materials are mixed to prepare a coating liquid for forming a charge transport layer:

| | |
|---|---|
| Polycarbonate resin Panlite K-1300 from Teijin Limited | 10 parts by weight |
| Charge transport material Having the following formula: | 10 parts by weight |

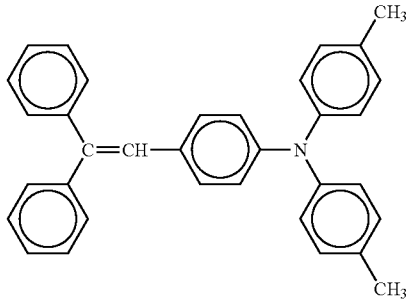

| | |
|---|---|
| Dichloromethane | 80 parts by weight |

The coating liquid is coated on the charge generation layer by a dip coating method, and dried at 120° C. for 15 minutes to form a charge transport layer thereon.

The flange 3 includes a plate 3*a*, a shaft 3*b* formed on one side of the plate 3*a*, and a boss 3*c* formed on the other side thereof. The boss 3*c* is inserted into the cylindrical substrate 2, and an outer circumferential surface of the boss 3*c* and an inner circumferential surface of the cylindrical substrate 2 are adhesively fixed with an adhesive. The adhered width can be set at 5 mm.

The plate 3*a* of the flange 3 includes two hole-shaped joints or joining portions 5 to which a claw 4*a* of a separation jig 4 is applied (FIG. 2). These joints 5 are formed such that a tensility is uniformly applied to a rim of the plate 3*a* when the claw 4 a of the separation jig 4 is applied to them in a separating direction (an axis direction of the cylindrical substrate 2). Specifically, the two joints 5 are symmetrically located with respect to the shaft 3*b* formed on the center of the plate 3*a*.

The plate 3*a* can include three or more joints, preferably located thereon such that a tensility is uniformly applied to a rim of the plate 3*a* when a claw of a separation jig is applied to them in a separating direction (an axis direction of the cylindrical substrate 2). Specifically, when the plate 3*a* includes three joints, they are preferably located on a concentric circle of the shaft 3*b* at intervals of 120°.

Various polymers such as an ABS resin, a polyacetal resin, and a PBT resin can be used as a material for the flange 3. Reflecting recent environmental protections, the resin preferably excludes a halogen atom such as polyvinylchloride. When a fire retardant is added to an organic polymer resin as the material for the flange 3, it is preferably a non-halogen fire retardant.

The flange 3 is adhesively fixed with the cylindrical substrate 2 with an adhesive, and the cylindrical substrate 2 is never bent. The adhesive is preferably an adhesive such as a cyano acrylate adhesive capable of adhering in a short time without affecting a photosensitive layer of the electrophotographic photoreceptor.

The process of separating the flange 3 from the cylindrical substrate 2 will be explained with reference to FIGS. 3A to 3F.

Figure 3A:
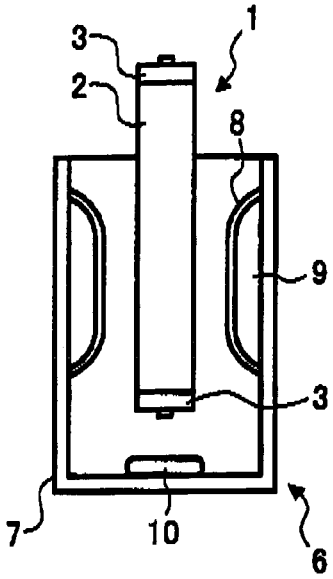
FIGS. 3A to 3F are drawings illustrating a first embodiment of procedures of separating a flange from a cylindrical substrate in the present invention.

FIG. 3A shows a status before setting an electrophotographic photoreceptor 1 in a jig 6 for grasping the electrophotographic photoreceptor. The jig 6 has a cylindrical jig frame 7 having one end closed and the other end open, and a doughnut-shaped elastic body 8 is formed on an inner circumferential surface of the jig frame 7. The elastic body 8 includes a hollow internal space 9, and is inflated by filling the space 9 with a fluid such as compressed air and contracted by letting the fluid out of the space 9. The jig frame 7 includes an opening (not shown) through which the fluid is filled in and let out of the space 9. The elastic body 8 is preferably formed of a rubber sheet, such as an isoprene rubber, a butadiene rubber, a styrene-butadiene rubber, a butyl rubber, chloroprene rubber, and a urethane rubber adhered to an inner circumferential of the jig frame 7. The space 9 is formed between the rubber sheet and the jig frame 7. The rubber sheet forming the elastic body 8 preferably has a thickness of from 1 to 8 mm. The closed end of the jig 6 has a grip 10 gripping an end of the electrophotographic photoreceptor 1.

Figure 3B:
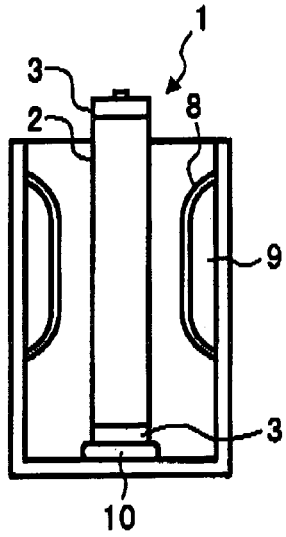

FIG. 3B shows a state of the electrophotographic photoreceptor 1 initially set in the jig 6. An end of the electrophotographic photoreceptor 1 is first gripped by the grip 10 to be securely held.

Figure 3C:
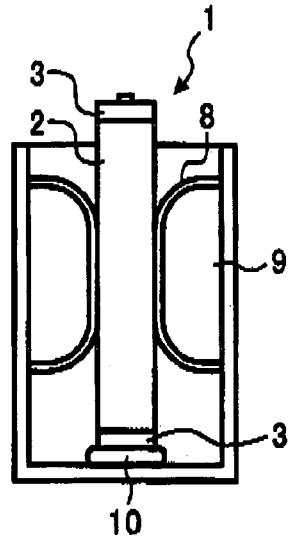

Then, as shown in FIG. 3C, the electrophotographic photoreceptor 1 is grasped by the elastic body 8, as the space 9 is filled with a fluid to inflate the elastic body 8 to be pressed against the outer circumferential of the electrophotographic photoreceptor 1.

Figure 3D:
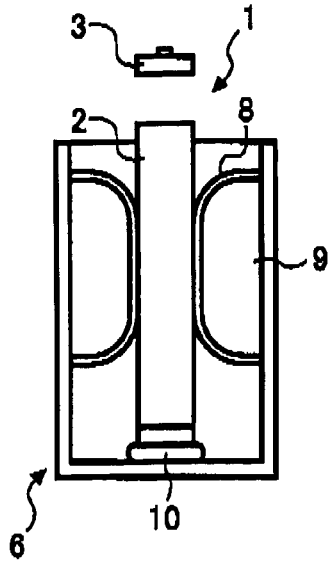

Then, as shown in FIG. 3D, the flange 3 is separated from the cylindrical substrate 2, wherein the claw 4*a* of the separation jig 4 is applied to the joint 5 of the flange 3 (refer to FIG. 2) to pull the flange 3 in a direction of separating the flange 3 from the cylindrical substrate 2 (along an axis direction thereof).

When the flange 3 is separated, the separation jig 4 applying the claw 4*a* to the joint 5 is moved in an axial direction of the cylindrical substrate 2, and a variety of movers such as an air cylinder, a ball screw, and a rack & pinion can be used to move the separation jig 4. The moving speed of the separation jig 4 can be determined in view of a desired operation efficiency and safety, and is preferably from 1 to 30 mm/sec. The moving distance thereof may be not less than an inserted length of the boss 3*c* of the flange 3 into the cylindrical substrate 2. However, when the inserted length of the boss 3*c* of the flange 3 into the cylindrical substrate 2 is, for example, 20 mm, the moving distance of the separation jig 4 may be, for example, 5 mm only to release the flange 3 from adherence to the cylindrical substrate 2, and the flange 3 may be released by other means.

Figure 3E:
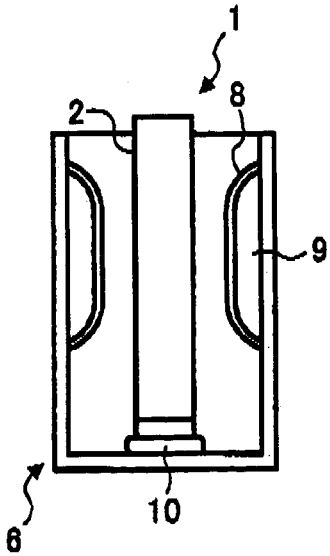

Then, as shown in FIG. 3E, the electrophotographic photoreceptor 1 is released from being grasped by the elastic body 8, which is contracted by letting the fluid out of the space 9.

Figure 3F:
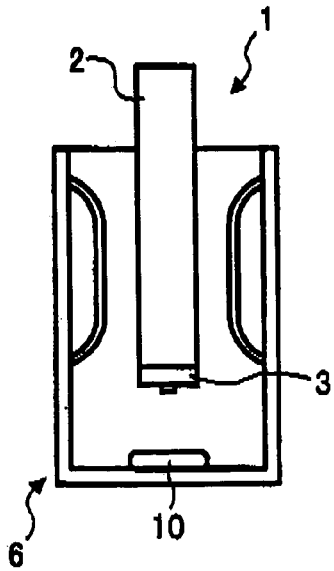

Then, as shown in FIG. 3F, the cylindrical substrate 2 is removed from out of the jig 6.

After the flange 3 is taken out from one side of the electrophotographic photoreceptor 1, the flange 3 at the other end may be pushed out from the other side thereof with a stick inserted from the side of the flange 3 already taken out. Or, the electrophotographic photoreceptor 1 can again be inserted upside down in the jig 6 and the operations of FIGS. 3B to 3F can be repeated to remove the other flange 3 as mentioned above.

When the space 9 of the elastic body 8 is filled with a fluid to inflate the elastic body 8 to be pressed against the outer circumferential of the electrophotographic photoreceptor 1 as shown in FIG. 3C, a pressure of the elastic body 8 grasping the electrophotographic photoreceptor 1 is almost uniformly applied thereto, and the cylindrical substrate 2 of the electrophotographic photoreceptor 1 is grasped without being deformed. Further, when the flange 3 is pulled in the direction of separating the flange 3 from the cylindrical substrate 2 after the elastic body 8 is pressed against the outer circumferential surface of the electrophotographic photoreceptor 1 to grasp the electrophotographic photoreceptor 1, the electrophotographic photoreceptor 1 grasped with the elastic body 8 pressed against the outer circumferential surface thereof can be displaceable according to the pulling direction. Therefore, the flange 3 can be pulled without pressing the rim thereof against the inner circumferential surface of the cylindrical substrate 2 with an uneven pressure, and the cylindrical substrate 2 and flange 3 can be separated from each other without being damaged and can thereby be recyclable as they are.

The elastic body 8 preferably has a hardness of from 10 to 90, and more preferably has a hardness of from 20 to 75 when measured by a method specified in JIS K6253 using a durometer. When the elastic body 8 has a hardness greater than 90, the cylindrical substrate 2 can be deformed when the electrophotographic photoreceptor 1 is grasped. When the hardness is less than 10, it is difficult to firmly grasp the electrophotographic photoreceptor 1.

In addition, the elastic body 8 preferably has a contact area with the electrophotographic photoreceptor 1 upon application of pressure not less than 12 $cm^2$. When the contact area is less than 12 $cm^2$, a pressure against the electrophotographic photoreceptor 1 increases and the cylindrical substrate 2 can be deformed.

A second embodiment of procedures of separating the flange from the cylindrical substrate in the present invention will be explained with reference to FIGS. 4A to 4D. Parts that are the same as previously explained in the other embodiment have the same reference numerals and an explanation thereof is omitted, which is same in the following other embodiments.

An electrophotographic photoreceptor 1 in FIGS. 4A to 4D is the same electrophotographic photoreceptor 1 in FIGS. 3A to 3F, and a flange 3 is adhesively fixed on each of both ends of a cylindrical substrate 2. The flange 3 has a pair of joints 5 (refer to FIG. 1).

In this embodiment, a jig 11 for grasping has a different structure from that of the jig 6 for grasping in FIGS. 3A to 3F. The jig 11 includes a jig frame 12 with both ends open, a doughnut-shaped elastic body 8 formed on an inner circumferential surface thereof and including a hollow interior space 9, and a support 13 supporting the electrophotographic photoreceptor 1.

Figure 4A:
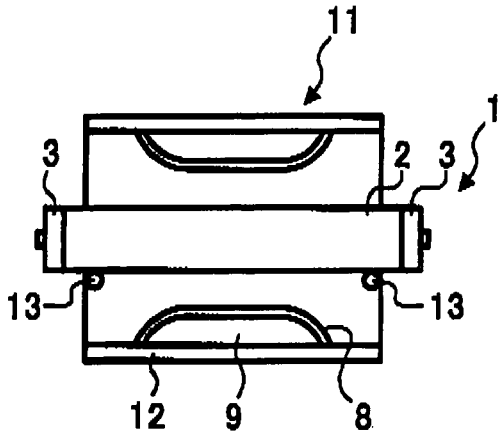
FIGS. 4A to 4D are drawings illustrating a second embodiment of procedures of separating a flange from a cylindrical substrate in the present invention.

When the flange 3 is to be separated from the cylindrical substrate 2, at first, as FIG. 4A shows, the electrophotographic photoreceptor 1 is located on the support 13 to be set in the jig 11.

Figure 4B:
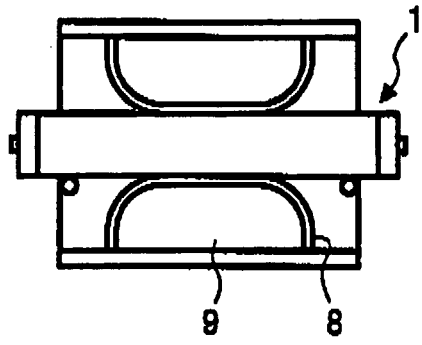

Then, as shown in FIG. 4B, the electrophotographic photoreceptor 1 is grasped by the elastic body 8, as the space 9 is filled with a fluid to inflate the elastic body 8 to be pressed against the outer circumferential of the electrophotographic photoreceptor 1.

Figure 4C:
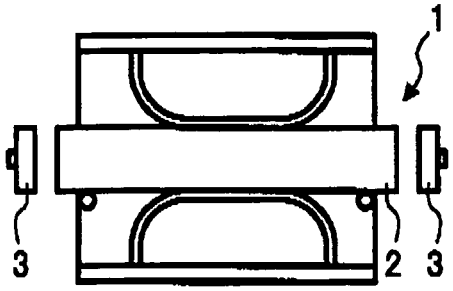

Then, as shown in FIG. 4C, flanges 3 at both ends of cylindrical substrate 2 are separated from the cylindrical substrate 2, wherein claws 4*a* of the separation jig 4 are applied to the joint 5 of the flanges 3 (refer to FIG. 2) to pull the flanges 3 in a direction of separating the flanges 3 from the cylindrical substrate 2 (along an axis direction thereof).

Figure 4D:
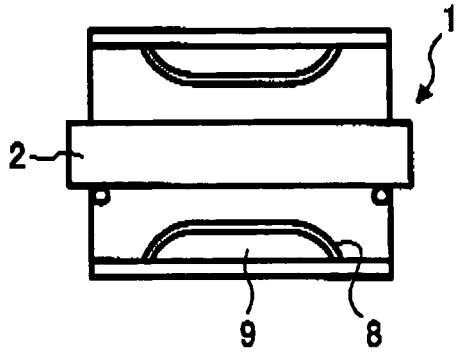

Then, as shown in FIG. 4D, the electrophotographic photoreceptor 1 is released from being grasped by the elastic body 8, which is contracted by letting the fluid out of the space 9.

A third embodiment of procedures of separating the flange from the cylindrical substrate in the present invention will be explained according to FIGS. 5A to 5F. An electrophotographic photoreceptor 1 in FIGS. 5A to 5F is the same electrophotographic photoreceptor 1 in FIGS. 3A to 3F, and a flange 3 is adhesively fixed on each of both ends of a cylindrical substrate 2. The flange 3 has a pair of joints 5 (refer to FIG. 1).

In this embodiment, a jig 21 for grasping has a different structure from those of the jigs 6 and 11 for grasping in FIGS. 3 and 4 respectively. The jig 21 includes a cylindrical jig frame 22 having one end closed and the other end open, and plural arc-shaped elastic bodies 23 separately located on an inner circumferential surface of the jig frame 22 each with a mover 24 capable of moving the elastic body 23 toward the center of the jig frame 22 and backward. The closed end of the jig 21 has a grip 10 gripping an end of the electrophotographic photoreceptor 1.

Figure 5A:
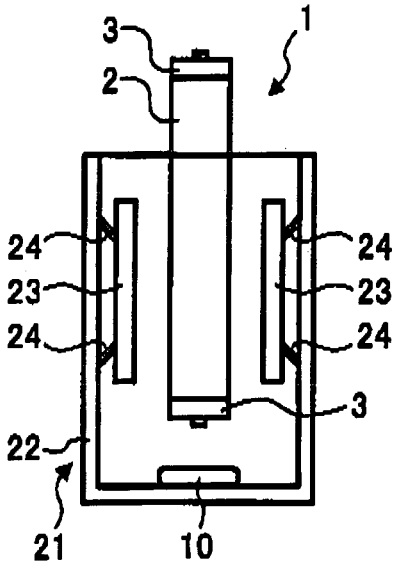
FIGS. 5A to 5F are drawings illustrating a third embodiment of procedures of separating a flange from a cylindrical substrate in the present invention.

FIG. 5A shows a state before setting an electrophotographic photoreceptor 1 in a jig 21 for grasping the electrophotographic photoreceptor. The elastic body 23 is located apart from the center of the jig frame 22.

Figure 5B:
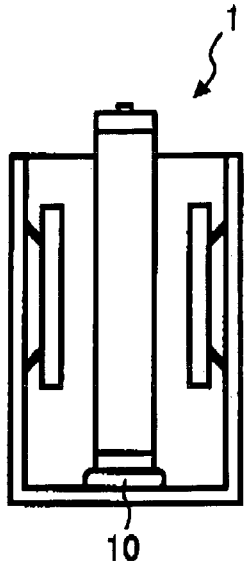

Then, as shown in FIG. 5B, the electrophotographic photoreceptor 1 set in the jig 21 such that an end of the electrophotographic photoreceptor 1 is gripped by the grip 10 to be securely held.

Figure 5C:
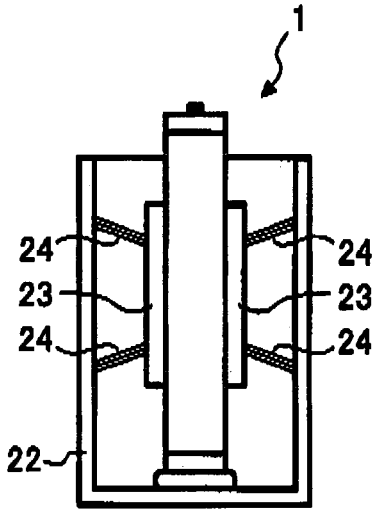

Then, as shown in FIG. 5C, each elastic body 23 is moved toward the center of the jig frame 22 by a respective mover 24. Each elastic body 23 moved toward the center of the jig frame 22 is pressed against an outer circumferential surface of the electrophotographic photoreceptor 1 to grasp the electrophotographic photoreceptor 1.

Figure 5D:
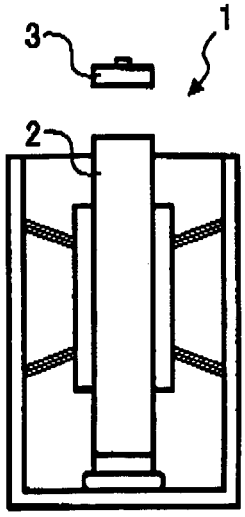

Then, as shown in FIG. 5D, the top flange 3 is separated from the cylindrical substrate 2, wherein the claw 4*a* of the separation jig 4 is applied to the joint 5 of the flange 3 (refer to FIG. 2) to pull the flange 3 in a direction of separating the flange 3 from the cylindrical substrate 2 (along an axis direction thereof).

Figure 5E:
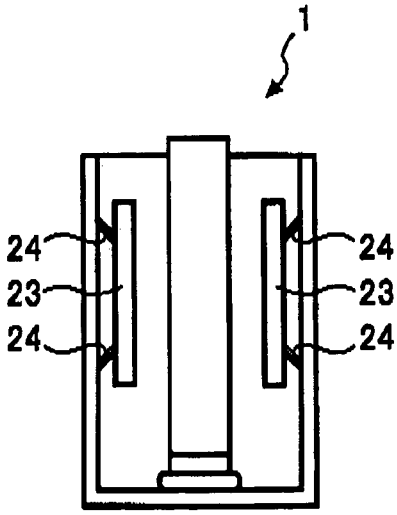

Then, as shown in FIG. 5E, the electrophotographic photoreceptor 1 is released from being grasped by each elastic body 23, which is moved by a respective mover 24 from the center of the jig frame 22.

Figure 5F:
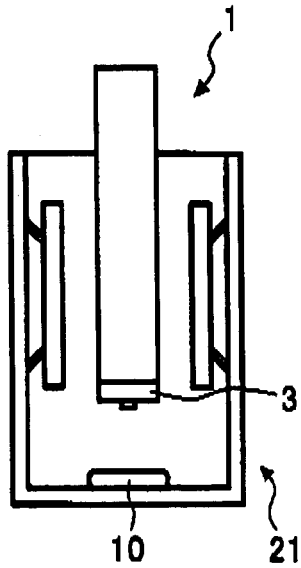

Then, as shown in FIG. 5F, the cylindrical substrate 2 is removed from out of the jig 21.

After the top flange 3 is taken out from one side of the electrophotographic photoreceptor 1, the flange 3 at the other end may be pushed out from the other side thereof with a stick inserted from the side of the flange 3 already taken out. Or, the electrophotographic photoreceptor 1 can again be inserted upside down in the jig 21 and the operations of FIGS. 5B to FIG. 5F can be repeated to remove the other flange 3 as mentioned above.

A second embodiment of the electrophotographic photoreceptor of the present invention will be explained with reference to FIGS. 6 and 7. That electrophotographic photoreceptor 31 includes a cylindrical substrate 2 and a pair of flanges 32 adhesively fixed to both ends of the cylindrical substrate 2. Each flange 32 includes a plate 3*a*, a shaft 3*b* formed on one side of the plate 3*a*, and a boss 3*c* formed on the other side thereof. Instead of the hole-shaped joints 5 of the first embodiment, a concave joint 33 is formed on the plate 3*a*.

Figure 6:
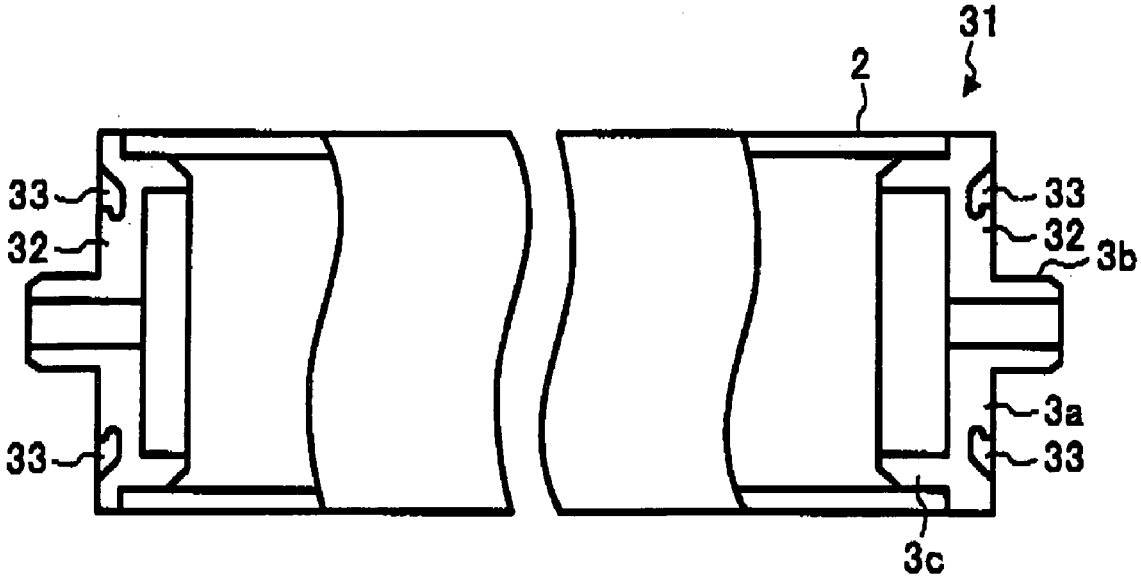
FIG. 6 is a schematic longitudinal sectional view illustrating a second embodiment of an electrophotographic photoreceptor of the present invention.

When the flange 32 is separated from the cylindrical substrate 2 of the electrophotographic photoreceptor 31, the electrophotographic photoreceptor 31 is grasped in FIGS. 6, 11, or 21 of the first, second, or third embodiments of procedures of separating the flange from the cylindrical substrate in the present invention respectively, a claw 4*a* of a separation jig 4 is applied to the joint 33 of the flange 32, and the flange 32 is pulled in a direction of separating the flange 32 from the cylindrical substrate 2 (along an axis direction thereof).

Therefore, the cylindrical substrate 2 and flange 32 are separated from each other without being damaged, and they are recyclable as they are.

A third embodiment of the electrophotographic photoreceptor of the present invention will be explained with reference to FIGS. 8 and 9. An electrophotographic photoreceptor 41 includes a cylindrical substrate 2 and a pair of flanges 42 adhesively fixed to both ends of the cylindrical substrate 2. Each flange 32 includes a plate 3*a*, a shaft 3*b* formed on one side of the plate 3*a*, and a boss 3*c* formed on the other side thereof. Instead of the hole-shaped joints 5 of the first embodiment, a convex joint 43 is formed on the plate 3*a*.

When the flange 42 is separated from the cylindrical substrate 2 of the electrophotographic photoreceptor 41, the electrophotographic photoreceptor 41 is grasped in FIGS. 6, 11, or 21 of the first, second, or third embodiments of procedures of separating the flange from the cylindrical substrate in the present invention respectively, a claw 4*a* of a separation jig 4 is jointed to the joint 43 of the flange 42, and the flange 42 is pulled in a direction of separating the flange 42 from the cylindrical substrate 2 (along an axis direction thereof).

Therefore, the cylindrical substrate 2 and flange 42 are separated from each other without being damaged, and they are recyclable as they are.

Having generally described the present invention, further understanding can be obtained by reference to certain specific examples that are provided herein for the purpose of illustration only and are not intended to be limiting.

EXAMPLES

Example 1

The electrophotographic photoreceptor 1 of the first embodiment was used, and the flange 3 was adhered to the cylindrical substrate 2 with ARONALPHA from Toagosei Co., Ltd. An adhered width of the flange to the cylindrical substrate 2 was 5 mm. The electrophotographic photoreceptor 1 was grasped by the jig 6 in FIGS. 3A to 3F. The jig 6 used a method of grasping the electrophotographic photoreceptor 1 by filling the space 9 of the elastic body 8 with compressed air to inflate the elastic body 8, and the compressed air had a pressure of 10,000 Pa. The elastic body had a hardness of 35 when measured by a method specified in JIS K6253 using a durometer.

Next, as shown in FIG. 2, the claw 4*a* of the separation jig 4 was inserted into the joint 5 of the flange 3, and the claw 4*a* was hooked on the joint 5 and the separation jig 4 was raised by an air cylinder. Consequently, the flange 3 could easily be separated from the cylindrical substrate 2.

After the flange 3 on one side of the electrophotographic photoreceptor 1 was separated, the compressed air in the space 9 was released therefrom to release the electrophotographic photoreceptor 1 from being grasped.

Next, a vinylchloride stick having an outer diameter of 30 mm and a length of 500 mm was inserted into the electrophotographic photoreceptor 1 from the side that the flange was removed from, and the flange 3 on the other side of the electrophotographic photoreceptor 1 was knocked out.

Then, the coated film over the electrophotographic photoreceptor 1 where the flange 3 was released from was removed with tetrahydrofuran and N-methyl-2-pyrrolidone, and the size of the cylindrical substrate 2 was measured by a measurer from Mitsutoyo Corp. Further, the total deflection amount of the cylindrical substrate 2 was measured by a deflection measurer from Ricoh Company, Ltd.

Damages and deformations of both of the flanges 3 were visually observed and the sizes thereof were measured by a three-dimensional measurer from Mitsutoyo Corp.

Example 2

Figure 7:
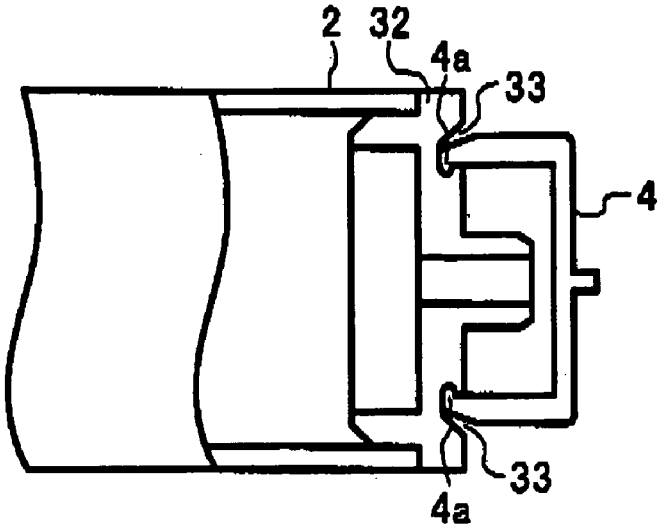
FIG. 7 is a schematic longitudinal sectional view illustrating a separation jig applied to a flange of the second embodiment of the electrophotographic photoreceptor in FIG. 6.

The procedures for evaluations of the flange cylindrical substrate and flange in Example 1 were repeated except for using the flange 32 in FIGS. 6 and 7 instead of the flange 3.

Example 3

Figure 8:
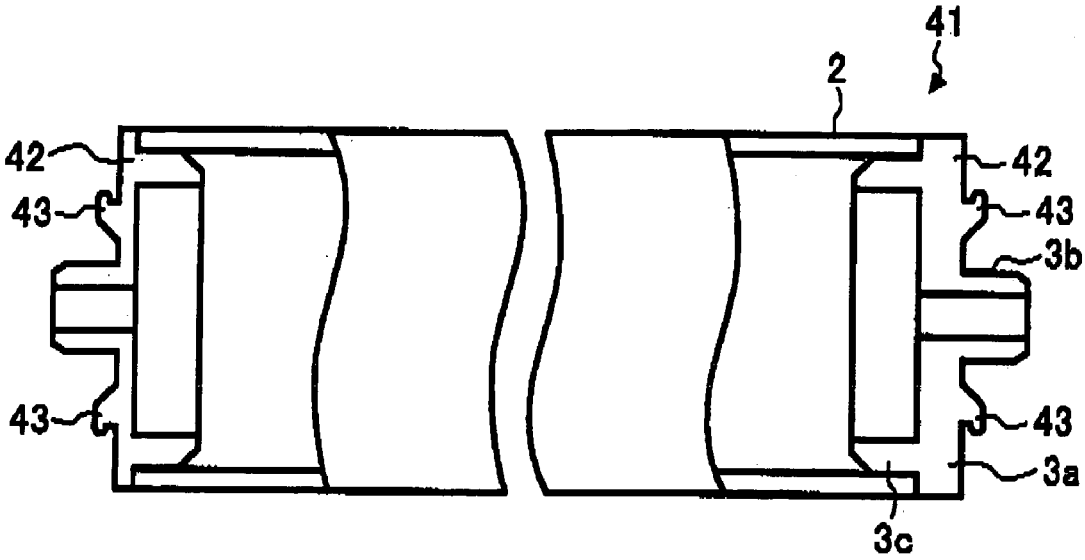
FIG. 8 is a schematic longitudinal sectional view illustrating a third embodiment of the electrophotographic photoreceptor of the present invention.
Figure 9:
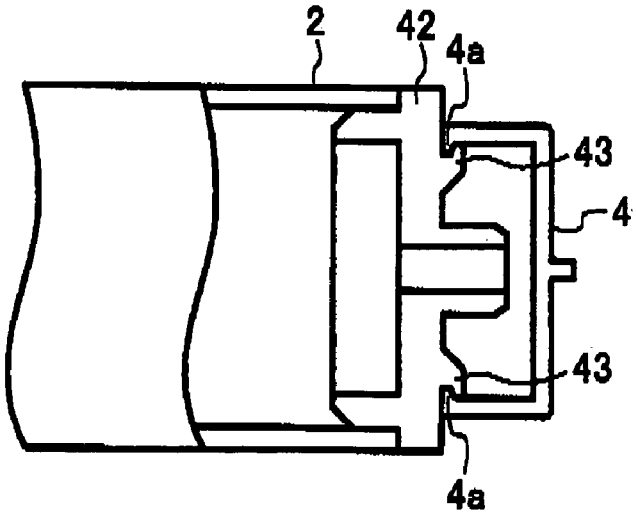
FIG. 9 is a schematic longitudinal sectional view illustrating a separation jig applied to a flange of the third embodiment of the electrophotographic photoreceptor in FIG. 8.

The procedures for evaluations of the flange cylindrical substrate and flange in Example 1 were repeated except for using the flange 42 in FIGS. 8 and 9 instead of the flange 3.

Example 4

The procedures for evaluations of the flange cylindrical substrate and flange in Example 1 were repeated except for using the jig 21 in FIGS. 5A to 3F instead of the jig 6.

Comparative Example 1

The procedures for evaluations of the cylindrical substrate and flange in Example 1 were repeated except for not using the jig 6 for grasping the electrophotographic photoreceptor 1.

Comparative Example 2

The procedures for evaluations of the cylindrical substrate and flange in Example 1 were repeated except that the flange did not have a joint and a driver was slowly inserted into a gap between the flange and cylindrical substrate 2 to remove the flange therefrom.

The evaluation results of Examples 1 to 4 and Comparative Examples 1 to 2 are shown in Table 1.

TABLE 1

| | Visual observation of photoreceptor after flange is removed | Size of cylindrical substrate | Appearance of flange | Size of flange |
|---|---|---|---|---|
| Example 1 | Normal | In standard | Normal | In standard |
| Example 2 | Normal | In standard | Joint slightly deformed | In standard |
| Example 3 | Normal | In standard | Joint slightly deformed | In standard |
| Example 4 | Normal | In standard | Normal | In standard |
| Comparative Example 1 | Slightly Deformed | Deformed, Rejected | Deformed | Rejected |
| Comparative Example 2 | Grasped part concave | Deformed, Rejected | Deformed | Rejected |

According to the evaluation results in Table 1, in Examples 1 and 4, both the cylindrical substrates and the flanges were normal and in standard form.

In Examples 2 and 3, the joints of the flanges were slightly deformed. However, the joint has nothing to do with the quality of an electrophotographic photoreceptor and could be recyclable. On the contrary, both the cylindrical substrates and the flanges were deformed in Comparative Examples 1 and 2, and could not be recyclable as they are.

Having now fully described the invention, it will be apparent to one of ordinary skill in the art that many changes and modifications can be made thereto without departing from the spirit and scope of the invention as set forth therein.

This document claims priority and contains subject matter related to Japanese Patent Application No. 2003-375720 filed on Nov. 5, 2003, the entire contents of which are hereby incorporated herein by reference.

What is claimed as new and desired to be secured by Letters Patent of the United States is:

1. An electrophotographic photoreceptor comprising:

a cylindrical substrate including a photosensitive layer on an outer circumferential surface thereof; and a flange adhesively fixed to at least one end of the cylindrical substrate, wherein the flange includes two or more joining portions symmetrically located on the flange and configured to receive a separation jig that applies a force in a direction of separating the flange from the cylindrical substrate such that the force is uniformly applied to a rim of the flange.

2. The electrophotographic photoreceptor of claim 1, wherein the joining portions have a shape of a hole.

3. The electrophotographic photoreceptor of claim 1, wherein the joining portions have a shape of a concavity.

4. The electrophotographic photoreceptor of claim 1, wherein the joining portions have a shape of a convexity.

5. A method of recycling an electrophotographic photoreceptor including a cylindrical substrate including a photosensitive layer on an outer circumferential surface thereof and a flange adhesively fixed to at least one end of the cylindrical substrate, the flange including a joining portion, the method comprising:

filling an elastic body with a fluid to inflate and contact the elastic body at the outer circumferential surface of the electrophotographic photoreceptor upon application of pressure to grasp the electrophotographic photoreceptor in a jig; and applying the jig to the joining portion to pull the flange in a direction of separating the flange from the cylindrical substrate.

6. The method of claim 5, wherein the elastic body has a hardness of from 10 to 90 when measured by a method specified in JIS K6253 using a durometer.

7. The method of claim 5, wherein the elastic body has a contact area with the electrophotographic photoreceptor upon application of pressure of not less than 12 $cm^2$.

8. The method of claim 5, wherein the flange includes two or more joining portions located thereon.

9. The method of claim 5, wherein the joining portion has a shape of a hole.

10. The method of claim 5, wherein the joining portion has a shape of a concavity.

11. The method of claim 5, wherein the joining portion has a shape of a convexity.

* * * * *